United States Patent [19]

Kinoshita et al.

[11] Patent Number: 4,733,129

[45] Date of Patent: Mar. 22, 1988

[54] STREAK TUBE

[75] Inventors: Katsuyuki Kinoshita; Yutaka Tsuchiya, both of Hamamatsu, Japan

[73] Assignee: Hamamatsu TV Co., Ltd., Hamamatsu, Japan

[21] Appl. No.: 335,203

[22] Filed: Dec. 28, 1981

[30] Foreign Application Priority Data

Mar. 6, 1981 [JP] Japan ..... 56-32899

[51] Int. Cl.[4] ..... H01J 31/50

[52] U.S. Cl. ..... 313/529; 313/537; 313/542

[58] Field of Search ..... 313/537, 538, 541, 542, 313/544, 529, 530, 381, 376, 373, 383; 250/213 VT

[56] References Cited

U.S. PATENT DOCUMENTS

| | | | |
|---|---|---|---|
| 2,189,322 | 2/1940 | Flory | 313/537 |
| 3,345,534 | 10/1967 | Charles | 250/213 VT |
| 3,391,295 | 7/1968 | Clayton | 313/381 |
| 3,761,614 | 9/1973 | Bradley | 313/529 X |
| 4,079,258 | 3/1978 | Franz et al. | 250/213 VT |
| 4,171,480 | 10/1979 | Wulms | 250/213 VT |
| 4,346,326 | 8/1982 | Driard et al. | 250/213 VT |

OTHER PUBLICATIONS

Prokhorov et al., "Anglo-Soviet Picosecond Streak Cameras", Proceeding of 14th International Congress High Speed Photography and Photonics, 1980, pp. 124–130.

Bryukhnevich et al., "Investigation of Peculiarities of Image Formation in an Electron-Optical Photochronograph with Subpicosecond Time Resolution", SPIE, vol. 348, High Speed Photography (San Diego), 1980, pp. 295–298.

*Primary Examiner*—David K. Moore
*Assistant Examiner*—Sandra L. O'Shea
*Attorney, Agent, or Firm*—Spencer & Frank

[57] ABSTRACT

A streak tube comprising an envelope having therein a photocathode surface, a mesh electrode, a focusing electrode, an aperture electrode, a deflection electrode and a phosphor screen positioned along the longitudinal axis of the envelope in the given order. The axis connects the photocathode surface and the phosphor screen which face each other. The photocathode is formed on a concave surface at one end of the envelope, the distance between the photocathode surface and the mesh electrode being greatest at the axis of the envelope and gradually decreasing toward its periphery. Electrons emitted from any position on the photocathode surface at a given instant enter simultaneously into the deflection field formed by the deflection electrode.

3 Claims, 9 Drawing Figures

STREAK TUBE

BACKGROUND OF THE INVENTION

This invention relates to a streak tube, which may be utilized, for example, in analyzing a light source whose strength changes rapidly.

The time resolving power of the streak tube is excellent, and it may be used to indicate a change of approximately one nanosecond in light incident thereon on a phosphor screen within a length of tens of milimeters, and to read out the change in less than two picoseconds. Thus the streak tube has conventionally been used to analyze the waveforms analysis of laser pulse light beams, etc.

First, the structure of the conventional streak tube and the problem to be solved according to this invention will be explained briefly with reference to the attached FIG. 1.

FIG. 1 is a longitudinal section showing the structure of a conventional streak tube. A schematic diagram showing a relation between a photocathode surface of the tube and an optical image is also shown in the figure.

One end of a vacuum and air-sealed tube 3 forms a window 1 through which an optical image to be analyzed is received, and the other end of the tube 3 forms a window 2 from which the processed image of the optical image is emitted. Between the windows 1 and 2 and along the tube axis of the tube 3 there are provided a photocathode surface 4, a mesh electrode 5, a focusing electrode 6, an aperture electrode 7, a deflection electrode 8 and a phosphor screen 9. The voltage applied to the mesh electrode 5 is higher than the voltage on the photocathode surface 4, and the voltage applied to the aperture electrode 7. Also, the same potential as that applied to the aperture electrode 7 is applied beforehand to the phosphor screen 9. Suppose that a line optical image 4*a* is projected onto the photocathode surface 4 through the window 1 by using an optical device, not shown, and that the image 4*a* passes through the center of the photocathode surface 4. The photocathode surface 4 emits an electron image which corresponds to the optical image projected thereon, and the emitted electrons are then accelerated by the mesh electrode 5 and converged by the focusing electrode 6. The electrons then pass the aperture electrode 7 and move towards the phosphor screen 9 through a gap in the deflection electrode 8. A deflection voltage is applied to the deflection electrode 8 for the period of time during which the line electron image passes the gap of the deflection electrode 8. The direction of the electric field generated by the deflection voltage is perpendicular to the axis of the tube 3 and also to the line electron image (that is, perpendicular to the plane of the paper in the sectional view of FIG. 1). The strength thereof is in proportion to the deflection voltage. On the phosphor screen 9 the line electron beam is scaanned in the perpendicular direction with respect to its line direction. Therefore the line image at first projected on the photocathode surface 4 is finally formed on the phosphor screen 9 as an optical image arranged one after one in the time sense in the perpendicular direction to the original line direction, the final image on the phosphor screen being called a streak image. The change in brightness of the arranged direction, or sweeping direction of the streak image thus indicates the time sense change of the strength of the incident optical image. Several methods hve conventionally been used to quantitate the change of time of the strength of the incident light from the streak image obtained on the phosphor screen 9 of the stream tube. One of them is a method of recording the streak image on a film and measuring its blackening density. Another method is to pick up a streak image by a TV camera and to then analyze the video signal thus obtained. Generally speaking, the light to be measured by the streak tube is extremely weak and moreover the time for measurement is extremely short. Therefore a good S/N ratio cannot be obtained. In order to improve this ratio, in either of the above methods the strength of the streak tube which corresponds to a certain time is either integrated or added. For example, in the former method, an aperture in the form of a slit is used for the film to seek an average blackening density of part of the film. In the latter method, the streak image on the phosphor screen is picked up by a TV camera so as to make the sweeping direction of the streak tube match with the vertical scanning direction thereof and a video signal is integrated for each scanning line. In order to employ these methods, the optical image of the same time is preferably a straight line image on the phosphor screen. However, as will be fully explained later, such an optical image does not become a straight line on the phosphor screen. Even if the optical image of the same time is a curve, a curved slit aperture may be used if this is known beforehand according to the above first method. According to the second method, the brightness signal of the optical image representing the same time is extracted from a video signal and it may be integrated. However, the degree of curveature in fact varies due to the change of sweeping speed, and so the form of slit must be changed or a further complicated operation becomes necessary. Calculation for such complicated operation requires, for example, several seconds even when a computer is used, and thus the operation can not follow the frame period of a video signal which is of one several tenth second. Also it cannot follow incident light which repeats at intervals of less than several seconds. On the other hand, the electron optics system of the streak tube other than the deflection system is revolutionally symmetrical with its axis running from the center of the photocathode surface to the center of the phosphor screen. And the electron image emitted from the photocathode surface is focused on an axis between the photocathode surface and the phosphor screen with an electron lens of the above electron optics system. The image is then reversed with respect to both the vertical and axial directions and projected thereafter onto the phosphor screen. The above is further explained hereinafter with reference to FIG. 1. Electrons emitted from the center a of the photocathode surface collide against the center b of the phosphor screen 9. Electrons from the point a′ which is apart from the center a of the photocathode surface 4 pass through a focusing point 11 and collide against a point b′ which is likewise apart from the center b of the phosphor screen 9. Electrons emitted from the photocathode surface are very rapidly accelerated in the direction of the tube axis between the photocathode surface 4 and the aperture electrode 7 and pass the aperture electrode 7 with a constant speed. However, they are not accelerated in the direction of the tube axis between the aperture electrode 7 and the phosphor screen 9, but are only deflected in the direction perpendicular to the plane of the figure by a deflection electric field. Therefore, the vertical (to the plane of the paper) position of the electrons passing through the center a of the photocathode surface 4 and emitted from any point on the line perpendicular to the deflection field (that is the line through a and a' of FIG. 1) at which the electrons collide with the phosphor screen 9 depends solely on the condition of the deflection voltage applied to the deflection electrode 8. Therefore if electrons enter into the deflection field simultaneously, the colliding position which is in the perpendicular direction to the sheet must the same in height. However, the distance from the point a' which is apart from the center a of the photocathode surface 4 to the incident point in the deflection field is longer than the distance from the center a. Therefore when the electrons are emitted simultaneously from the center a of the photocathode surface 4 and from the point a' apart from the center a, the electrons emitted from the latter point enter into the deflection field later than those emitted from the center a. In other words, a straight line optical image 4*a* entered from the photocathode surface 4 becomes a curve 12 which is convex in the sweeping direction. This is schematically shown in FIG. 2. The arrow A in the figure indicates the sweeping direction. When the sweeping speed is changed, the curvature of the curve 12 will change.

As above explained, if a line optical image which enters into the photocathode surface 4 at the same time appears as a curve on the phosphor screen 9, it is not proper to use the method of picking up the phosphor screen by a pick-up tube and of integrating the video signal of each scanning line. This is because a signal obtained by integration is only a mixed image of different time.

The object of this invention is therefore to provide a streak tube of the type having an electronic optical system where an electron image focused and then formed as an image, in which a linear image entered into the photocathode surface at the same time will appear as a linear image on the phosphor screen irrespective of the sweeping speed.

SUMMARY OF THE INVENTION

In order to fulfill the above object, the streak tube according to the present invention is provided with a photocathode surface formed on a rounded face and further provided with a flat mesh electrode in a position facing the photocathode surface. The distance between the mesh electrode and the photocathode surface is largest at the center of the photocathode surface and is made gradually shorter towards the periphery thereof. With this structure, the time when electrons emitted from the center of the photocathode surface enter into the deflection field and those from points separated from the center is made identical. With the above structure, electrons emitted at the same time corresponding to a linear image entered into the photocathode surface will enter onto a straight line on the phosphor screen. Thus the object of this invention is fully fulfilled.

BRIEF DESCRIPTION OF THE DRAWINGS

The advantages and objects of this invention will become more readily appreciated by reference to the following detailed description when taken in conjunction with the accompanying drawings, wherein.

DESCRIPTION OF A PREFERRED EMBODIMENT

Figure 1:
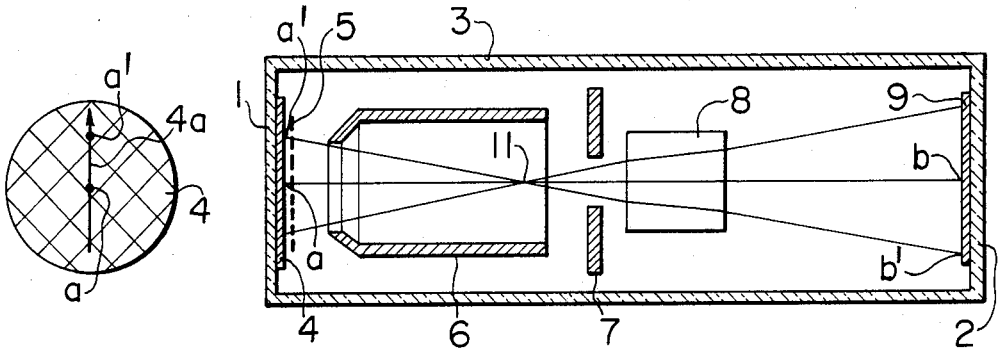
FIG. 1 PRIOR ART
FIG. 1 is a longitudinal section showing the structure of the conventional streak tube, accompanied by a schematic diagram showing an optical image on the photocathode surface.
Figure 2:
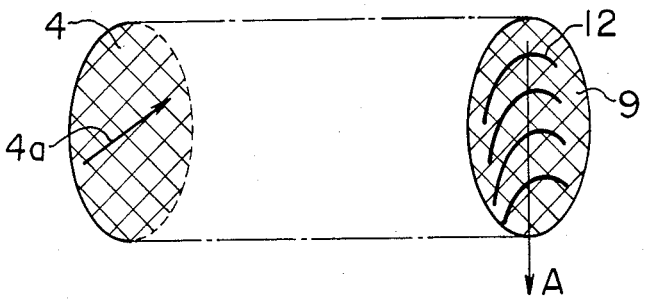
FIG. 2 is a schematic view showing a curved line image on the phosphor screen.
Figure 3:
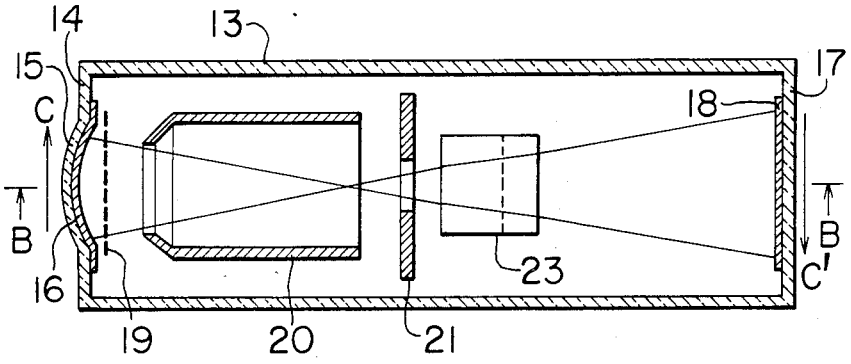
FIG. 3 is a longitudinal section of the streak tube according to an embodiment of this invention.
Figure 4:
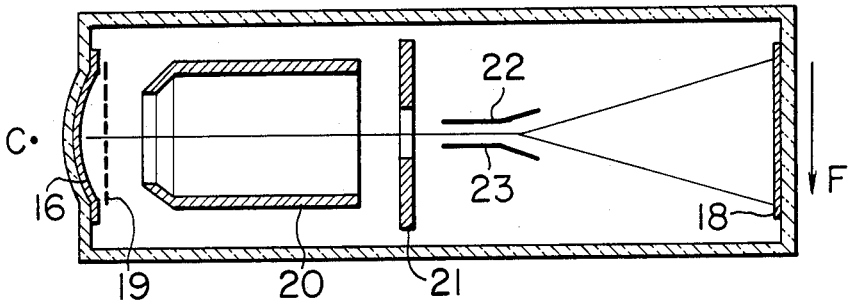
FIG. 4 is a section taken along the line B—B of FIG. 3.
Figure 6:
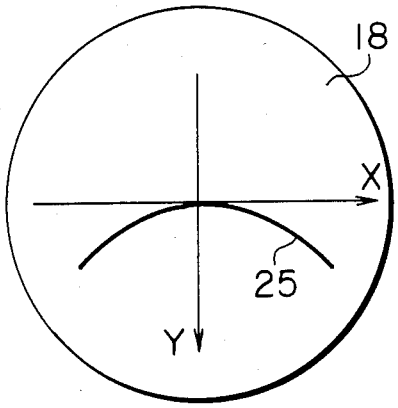
FIG. 6 is a diagram showing a method of evaluating a curved image appearing on the phosphor screen of the streak tube.
Figure 7:
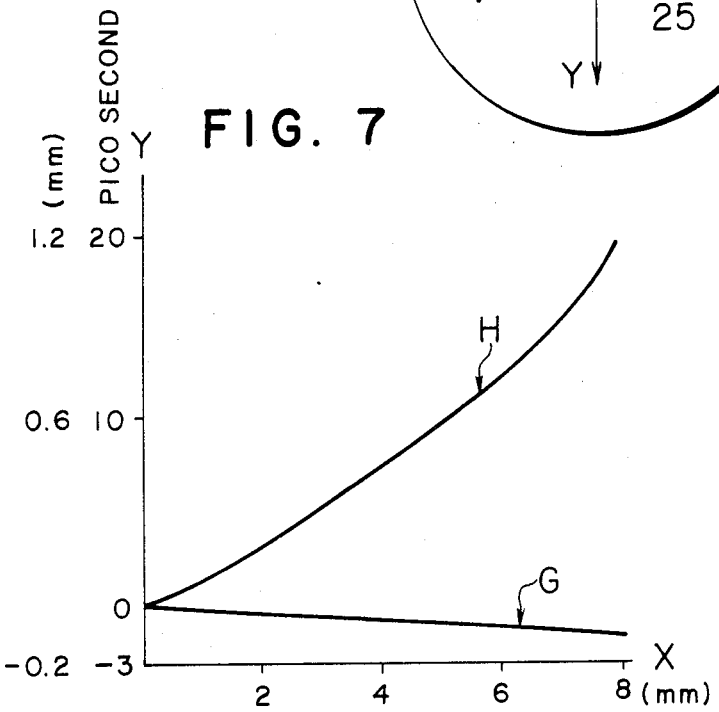
FIG. 7 is a graphical diagram showing the comparison of the characteristics of the conventional device and the streak tube of this invention.
Figure 5:
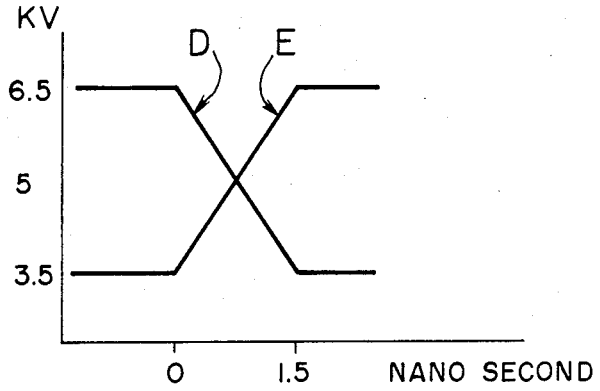
FIG. 5 is a diagram showing the waveform of the voltage which is applied to the deflection electrode of the streak tube of this invention.
Figure 8:
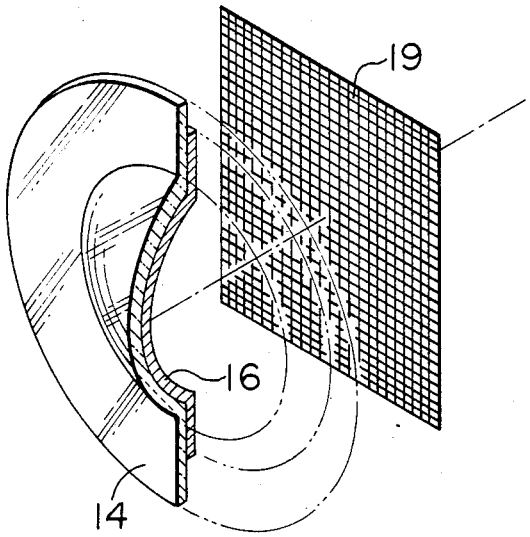
FIG. 8 is a schematic representation showing a photocathode surface formed on a spherical surface and a mesh electrode.

The invention will now be explained in connection with preferred embodiment in comparison with the conventional system. FIGS. 3 and 4 show the respective longitudinal sections of a first embodiment of the streak tube according to the present invention. In FIG. 3, the direction of the deflection field is perpendicular to the cutting plane of the figure, and FIG. 4 is a section taken along the line B—B of FIG. 3. The direction of the deflection field is parallel with the cutting plane. An air-sealed tube envelope 13 made of glass is in the form of a tube having a diameter of 40 mm and a length of 150 mm. The inner wall of the first base 14 of the tube 13 is a rounded face 15 which extends from its center for 10 mm in radius. The round face 15 has a center on the tube axis of the air-sealed tube and is spherically concave outwardly, and the radius of the sphere being is 50 mm. The photocathode surface 16 is formed on the spherical surface 15. Any spherical face having a center on the tube axis may be used, irrespective of the angle of the deflection electrode against the tube axis, thus enabling assembly of the system. FIG. 8 shows the relation of a photocathode formed on the spherical surface and a mesh electrode 19. A second base 17 is flat and on the inner surface thereof is formed the phosphor screen 18. The distance between the photocathode surface 16 and the mesh electrode 19 is 1 mm on the tube axis and 0.84 mm at points spaced 4 mm from the tube axis. A focusing electrode 20 is inflected inwardly by 30° at one side facing the photcathode surface 16, the diameter of the inflected edge adjacent the photocathode surface being 8 mm. The length of the focusing electrode 20 is 35 mm. An aperture electrode 21 is a flat electrode having a circular aperture and is disposed at a distance of 55 mm from the photocathode surface and also perpendicularly to the tube axis of the air-sealed tube 13. Deflection electrodes 22 and 23 consist of parallel flat plates, and the distance between the end of the phosphor screen side of the deflection electrodes and the phosphor screen 18 is 70 mm. In the streak tube thus constructed, the photocathode surface 16 is grounded and voltages of 1 KV, 960 V, 5 KV and 5 KV are applied respectively to the mesh electrode 19, focusing electrode 20, aperture electrode 21 and phosphor screen 18. When an optical image in a line form within the sheet as indicated by the arrow C in FIG. 3 is formed, an electron image emitted from the photocathode surface 16 is converged between the focusing electrode 20 and the aperture electrode 21, spreads and an image C' is obtained on the phosphor screen 18, which is inverted with respect to the image C. In this state, the deflection voltage D in FIG. 5 which varies from 6.5 KV to 3.5 KV for 1.5 nanoseconds is applied to the deflection electrode 22 shown in FIG. 4, while to the deflection electrode 23 a deflection voltage E which varies from 3.5 KV to 6.5 KV is applied, the voltage E being synchronized with the deflection voltage D. The straight line image is thereby swept in the direction F shown in FIG. 4. On the other hand, in the conventional streak tube, the first base is made flat and the photocathode surface is formed on the inner wall thereof. A gap of 1 mm separates the photocathode surface from the mesh electrode. Other structures are the same as those used in the embodiment of the streak tube of this invention shown in FIGS. 3 and 4. In the conventional streak tube, the same voltages are applied to the electrodes. FIG. 6 shows a method of evaluating the curve 25 of the line image appearing on the phosphor screen. In the diagram, the origin of the coordinate axes corresponds to the center of the photocathode surface. Its Y axis represents the sweeping direction of the streak tube and its X axis is perpendicular to the Y axis. The top of the protrusion of the curve 25 is made the origin in the figure. The position (X,Y) of the parts of the image 25 indicated by the coordinate as above set is shown in FIG. 7. In the figure, the line G represents the characteristic of the embodiment of the streak tube of the present invention and the image shown is in a range of the 0.12 mm of Y axis within 8 mm from the center of the phosphor screen and H relates to the conventional streak tube and is in the range of 1.2 mm. The scales of the Y axis having the unit of picoseconds is the conversion values of positional shear in the scanning direction on the phosphor screen and represent the travelling time lag causing the curving of the line image. By the conversion of above-mentioned distance by time, 2 picoseconds and 20 picoseconds will be obtained. Scales of unit mm given in the X axis change by changing the changing speed of the deflection voltage, while the picosecond scale is not changed. When the line image appearing on the phosphor screen 18 of the streak tube is picked up by a pick-up tube which scans horizontally in a direction parallel with the X axis of FIG. 6 and the video signals obtained are integrated on each scanning line for 8 mm from the center to right and left, respectively in the X axis direction, signals with a time lag of more than 2 picoseconds are not integrated by the streak tube of the present invention, and for this reason there will be no deterioration of time resolving power for signals having a time lag of more than 2 picoseconds. Thus measurement for a large S/N ratio may be made. On the other hand, such measurement by a conventional streak tube will result in deterioration of time resolving power for 20 picoseconds or so. It will be realized that even a time resolving power of less than 20 picoseconds is extremely objectionable for the streak tube.

Figure 9:
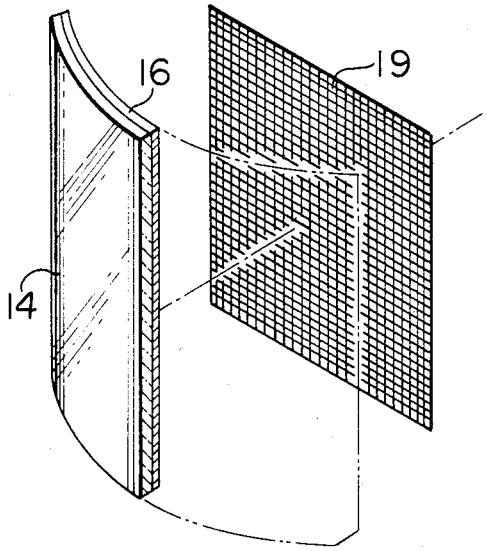
FIG. 9 is a schematic representation showing a photocathode formed on a cylindrical surface.

In the second embodiment of this invention, a cylindrical body having a radius of 50 mm is substituted for the inner wall of the first base 14 of the first embodiment, the cylindrical body having an axis parallel with the deflection field and crossing the axis of tube 13. The relation of the photocathode and the mesh electrode in this embodiment is shown in FIG. 9. The cylindrical body is concave outwardly. The operation of the second embodiment until the line optical image entered into the photocathode surface is indicated as the streak image on the phosphor screen is the same as that explained with reference to the first embodiment. Since the electric field between the photocathode surface and the mesh electrode does not change, the position of projecting an optical image may easily be set, even when the position of the image changes on the photocathode surface in the direction of the deflection field.

Many modifications and changes may be made within the scope of this invention on the embodiments above explained in detail. A multichannel plate may be provided spaced closely to the phosphor screen in order to raise the brightness of the image appearing on the phosphor screen 18. In such a case, the phosphor screen 18 of the embodiments may be substituted with the face of the multichannel plate opposing the photocathode surface. The present invention may thus be utilized in a streak tube incorporating the multichannel plate therewithin.

It is desired that the appended claims be given a broad interpretation commensurate with the scope of the invention within the art.

What we claim is:

1. A streak tube, comprising:

an envelope having a longitudinal axis and first and second opposite ends, the first end of said envelope having a concave internal surface;

a photocathode surface formed within said envelope on said concave internal surface;

a mesh electrode mounted within said envelope adjacent said photocathode surface, the distance between said photocathode surface and said mesh electrode being maximum along the longitudinal axis of said envelope and decreasing gradually toward the periphery thereof;

a phosphor screen affixed to the interior of the second end of said envelope facing said photocathode surface;

an aperture electrode interposed between said mesh electrode and said phosphor screen;

a focusing electrode interposed between said mesh electrode and said aperture electrode; and a deflection electrode interposed between said aperture electrode and said phosphor screen, electrons emitted from any position on said photocathode surface at a give instant being transmitted through the envelope to enter simultaneously into the deflection field generated by said deflection electrode.

2. A streak tube as defined by claim 1 wherein the concave surface on which said photocathode surface is formed is spherical, the center of said sphere being on the longitudinal axis of said envelope.

3. A streak tube as defined by claim 1 wherein the concave surface on which said photocathode surface is formed is cylindrical, the axis of said cylinder being parallel to said deflection field and perpendicular to the longitudinal axis of said envelope.

* * * * *